US007506445B2

(12) United States Patent
Buyse et al.

(10) Patent No.: US 7,506,445 B2
(45) Date of Patent: Mar. 24, 2009

(54) FOIL CUTTING DEVICE

(75) Inventors: Delphine Pauline Buyse, Voorburg (NL); Patrick Lambertus Kerkhof, Zoetermeer (NL); Arnoldus Willem Zweekhorst, Delfgauw (NL)

(73) Assignee: Vacu Vin Innovations Ltd., Queensway, Gibraltar (GB)

( * ) Notice: Subject to any disclaimer, the term of this patent is extended or adjusted under 35 U.S.C. 154(b) by 28 days.

(21) Appl. No.: 11/483,973

(22) Filed: Jul. 10, 2006

(65) Prior Publication Data

US 2007/0011878 A1 Jan. 18, 2007

(30) Foreign Application Priority Data

Jul. 8, 2005 (NL) ..... 1029479

(51) Int. Cl.
*B67B 7/00* (2006.01)

(52) U.S. Cl. ..... 30/1.5; 30/102

(58) Field of Classification Search ..... 30/1.5, 30/91.2, 95, 253, 263, 265, 278, 279.2, 299, 30/102; D8/41
See application file for complete search history.

(56) References Cited

U.S. PATENT DOCUMENTS

| | | | | |
|---|---|---|---|---|
| 2,227,421 | A | 1/1941 | Bjork | |
| 2,503,517 | A * | 4/1950 | Sirica | 30/94 |
| 2,566,653 | A | 9/1951 | Callahan et al. | |
| 4,845,844 | A * | 7/1989 | Allen | 30/1.5 |
| 4,852,255 | A * | 8/1989 | Hochfeld | 30/102 |
| D397,922 | S * | 9/1998 | Gort-Barten | D8/41 |
| 6,263,761 | B1 * | 7/2001 | Ryder | 81/3.09 |
| D446,103 | S * | 8/2001 | Olaneta | D8/98 |
| 6,658,742 | B2 * | 12/2003 | Votolato | 30/280 |
| D490,286 | S | 5/2004 | Simons | |
| D501,774 | S * | 2/2005 | Bates et al. | D8/41 |
| 2002/0092169 | A1 | 7/2002 | Kilduff | |

FOREIGN PATENT DOCUMENTS

| | | |
|---|---|---|
| DE | 3927261 A1 * | 2/1991 |
| EP | 1 086 925 | 3/2001 |
| FR | 2 142 794 | 2/1973 |

* cited by examiner

*Primary Examiner*—Hwei-Siu C Payer
(74) *Attorney, Agent, or Firm*—The Webb Law Firm

(57) ABSTRACT

Foil cutting device for cutting a sealing foil of a bottle. This foil cutting device is of the type which is positioned from above on the bottle. To that end a cutting device is provided with a stop determining the distance between the free extremity of the bottle and the cutting knives. The foil cutting device comprises two side portions and an upper portion connecting the side portions being integral with the side portions. In this way and elastically pivoting structure results, such that foil material can be cut with a lot of feeling. Between the side portions an opening is delimited and on one of the side portions a cavity for fingers is provided so that it is clear for the user in which direction a pinching force should be exerted for cutting the foil. The cutting knives are conically flared to a plane embodied such that after cutting the resilient foil material is run up by the cutting knives and can easily be removed.

10 Claims, 3 Drawing Sheets

FOIL CUTTING DEVICE

The present invention relates to a foil cutting device for cutting of a sealing foil of a bottle comprising two side portions being connected by an upper portion to be placed on the free extremity of the bottle, wherein each side portion comprises a support point for engagement on a bottle and wherein a side portion comprises a cutting knife.

More in particular, the present invention relates to a foil cutting device, which is positioned from above on the free extremity of a bottle. Subsequently, separation of the upper portion of the foil relative to the remaining portion is effected by a rotational movement around the axis of the bottle and clamping together the side portions and so the cutting knife, after which the foil can simply be removed.

Such a foil cutting device is known from U.S. Pat. No. 490,286 S.

The separate upper portion is embodied in such a way that it pivotally receives the side portions.

In such a foil cutting device simple operation is of importance. In the device according to U.S. Pat. No. 490,286 S the user has to move both side portions apart before the device can be placed on the bottle. After that the cutting movement described above is effected by pinching the two side portions together. After completing the cutting process the user has to move both side portions from each other.

U.S. Pat. No. 2,227,421 discloses a seal cutting device being made from a metal and having a serration at its lower end.

US 2002/0092169 discloses a foil cutter comprising two side parts being connected through a separate circular disc-shaped connector.

The invention aims to provide a cutting device which can be handled more simply. Furthermore it should be cheaper to produce at a low use of material.

This aim is realized with a foil cutting device as described above in that said side portions and side upper portion are realized from a single plastic material portion, said upper part comprising an L-shaped material section. According to the invention the side portion and upper portion comprise a continuous part of material. This can simply be produced, e.g. by injection molding in a step from plastic material. Problems with regard to connection of the side portions to the upper portion are no longer present. Furthermore, the inherent elasticity of the material can be used. This means that a resilient structure is obtained, wherein the embodiment is such that in non-engaged position the two side portions are placed such that without further action the cutting device can be placed over the bottle having the largest designed diameter neck. Subsequently the side portions have to be moved towards each other by pinching. After completion of the cutting step by simple decreasing of the pinching force or even releasing the side portions can automatically move outwardly to the starting position, after which removal of the cutting device can simply be effected. Because of the L-shaped section of the upper part the resilient properties of the upper portion can be accurately controlled while the user has the feeling to engage a quality product. Permanent deformation of the plastic material is prevented because of the L-shaped upper portion.

Of course, the device is embodied such that under the most extreme circumstances no permanent (plastic) deformation occurs in the material. This can e.g. be realized by stops which limit the movement of the two side portions toward each other. According to a preferred embodiment of the present invention these stops are not provided to the extremity of the cutting device, as is shown in U.S. Pat. No. 490,286 S, but internally thereof and more in particular between both support points, support point cutting knife respectively of each side portion. Because of that the stops are no longer shown and pinching of parts of the human body is avoided. This also gives the opportunity to have an opening in the outer wall of the side portions at the location where these side portions come together. During cutting the user can observe the cutting process through such an opening, i.e. he can see the groove of a cutting line. Preferably the minimum width of such opening is about 10 mm, more in particular about 15 mm. In the non-pinched condition such an opening can have a width of 25 mm at maximum, more in particular about 23 mm at maximum. Secondly, it is a clear indication for the user on which spot he has to exert a pinching force with his fingers for moving the side portions towards each other. This effect can further be promoted by providing a recess in the remaining wall of the side portions for receiving a finger or the like.

According to a further preferred embodiment of the invention the L-shape of the upper portion comprises a bridge. Such a bridge can have a varying cross-sectional size adapted in such a way that on the one hand sufficient strength or resilience respectively is obtained and on the other hand in such a way that no permanent deformation occurs during movement of the side portions together. According to a further preferred embodiment of the invention two spaced bridges are provided and more in particular this spacing is such that therein between the seal of a bottle, such as a cork, can be received.

Preferable the cutting knife comprises a cutting wheel. Although the cutting, points can be embodied as being non-cutting, according to a preferred embodiment of the invention it is possible to have the support points as cutting wheels. More in particular, each side portion is provided with two cutting wheels. According to a particular embodiment of the invention the cutting wheels conically flare to the upper portion. At the upper side the cutting wheels are always provided with a plane. In this way the foil material will resiliently move somewhat back over this plane and moving somewhat back in the pinched condition of the cutting device the foil portion to be removed is rolled up simplifying the subsequent removal thereof.

The stop means described above for restricting movement of the side portions towards each other can also be combined with the stop means restricting downward movement of the cutting device on the bottleneck. Preferably these further stop means are embodied such that the spacing from the cutting line of the cutting knife to the upper side of the bottle is between 3-8 mm and preferably about 5-6 mm and more in particular about 5.5 mm. It has been found that at the majority of bottles at that position an area is provided in which the foil is not tensioned against the wall of the bottle so that cutting can be effected on that location in a very simple way.

The invention will further be elucidated referring to an embodiment shown in the drawing.

Figure 1:
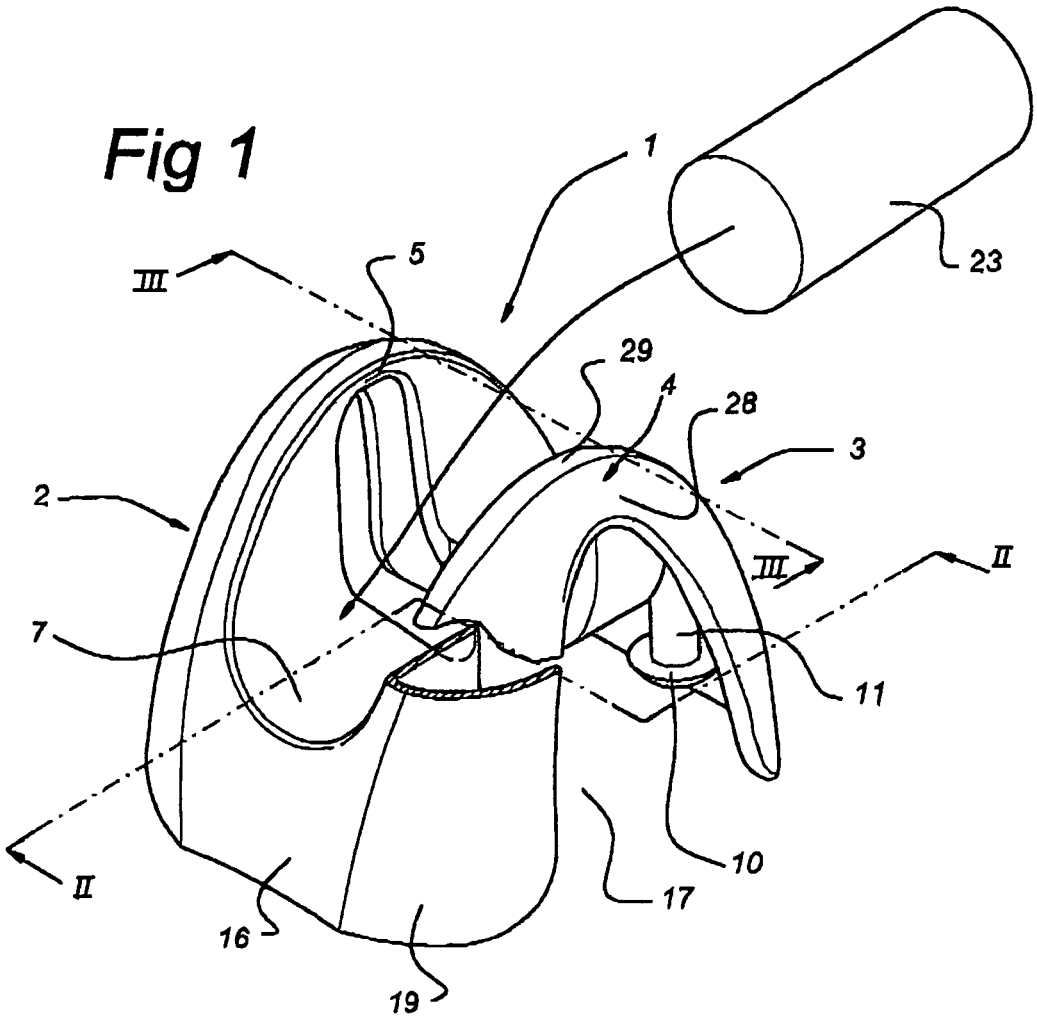
FIG. 1 shows schematically in perspective an embodiment of the cutting device according to the present invention.

In the FIG. 1 refers to the cutting device. This foil cutting device comprises two opposite side portions 2 and 3. In the subject example these are connected by two spaced bridge portions 4 and 5 defining an upper portion. Bridge portions 4 and 5 and side parts 2 and 3 are made from a single plastic material by injection molding. It will be understood that the bridge portions can be realized in another way and possibly a single bridge portion is present as upper portion. In the present embodiment between the bridge portions 4 and 5 a space 6 is delimited having a plane 7 at its lower side. This space 6 can receive a schematically shown cork 23.

Figure 2:
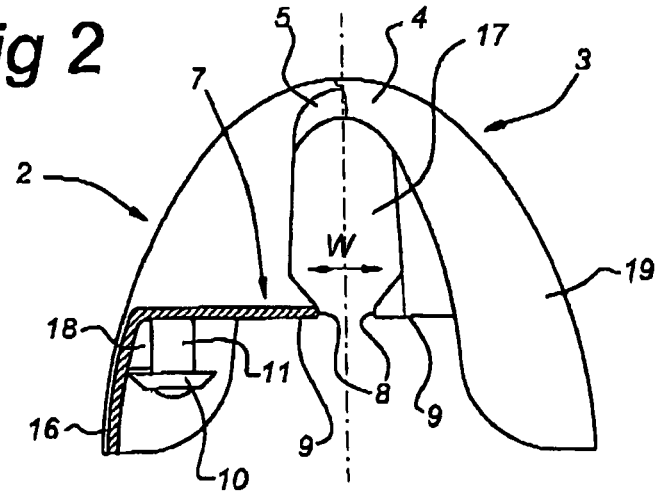
FIG. 2 shows the cross-section according to line II-II in FIG. 1.
Figure 3:
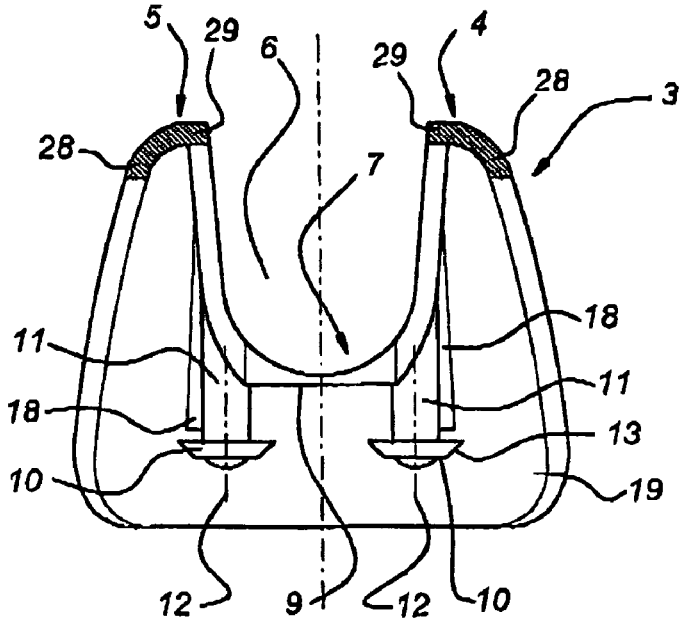
FIG. 3 shows the cross-section according to line III-III in FIG. 1.

In FIG. 1 the cutting device according to the invention is shown in non-engaged condition. It is clear that between the side portions an opening remains whilst in the wall part 19 of the side portions a cavity 16 is provided for receiving a finger. In FIGS. 2 and 3 different cross-sections of the bridge portion 5 are shown. From FIG. 1 it is clear that at relatively low level the cross-section is U-shaped, whereas at the upper side, as shown in FIG. 3, the bridge portion is substantially flat. It has been found that in this way on the one hand an optimum pivoting action can be obtained and on the other hand deformation of material is prevented. Furthermore, coloring of the plastic material can effectively be prevented. The bridge portion should at least comprise an L-shape, i.e. have two legs which extend in a different direction. In FIG. 1 these legs are referred to by 28 and 29.

In FIG. 2 a partial cross-section of the device shown in FIG. 1 is shown from which further details are clear. In this figure it is shown that part 7 defines stop surfaces 8 and 9. Stop surfaces 8 function to limit moving together of the side portions 2 and 3. Stop surfaces 9 function to restrict the downward movement of the cutting device on a bottle.

The cutting knives are realized as cutting wheels being referred to by 10. These wheels rotate around shafts 11 being pressed into the plastic material. The axis of rotation is referred by 12 and extend substantially perpendicular to the (imaginary) pivot line 35 between the two side portions 2 and 3. It is clear from FIG. 4 that a reinforcement rib 18 is provided such that the pressure force entered through wall 19 can directly be transferred to the cutting wheels 10. It is also clear that the cutting wheels 10 are conically flaring in the direction of the bridge sections 4, 5. This conical section is referred to by 13 and from FIG. 4 it is clear that it is transferred into a flat surface 14. Furthermore a finding effect is obtained by having cutting wheels embodied conically in this way during provision of the device on the bottle if the user exerts a relatively low pinching force on the two side portions.

The distance between the flat surface 14 and surface 9 has been referred to by a (see FIG. 5) and this distance is preferably between 3-8 mm and is about 5-6 mm in the subject embodiment.

Figure 5:
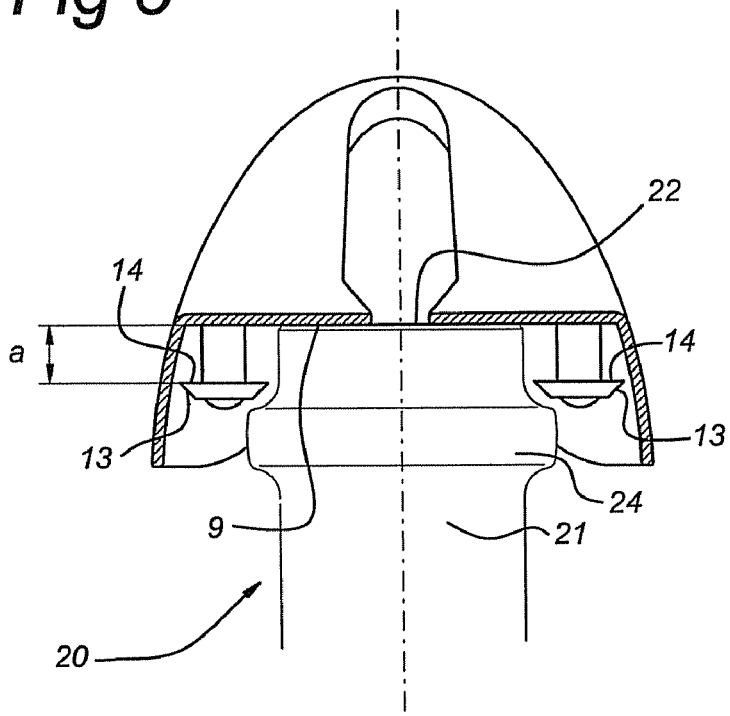
FIG. 5 shows the cross-section of the device according to the invention in its position on the bottle before cutting.
Figure 6:
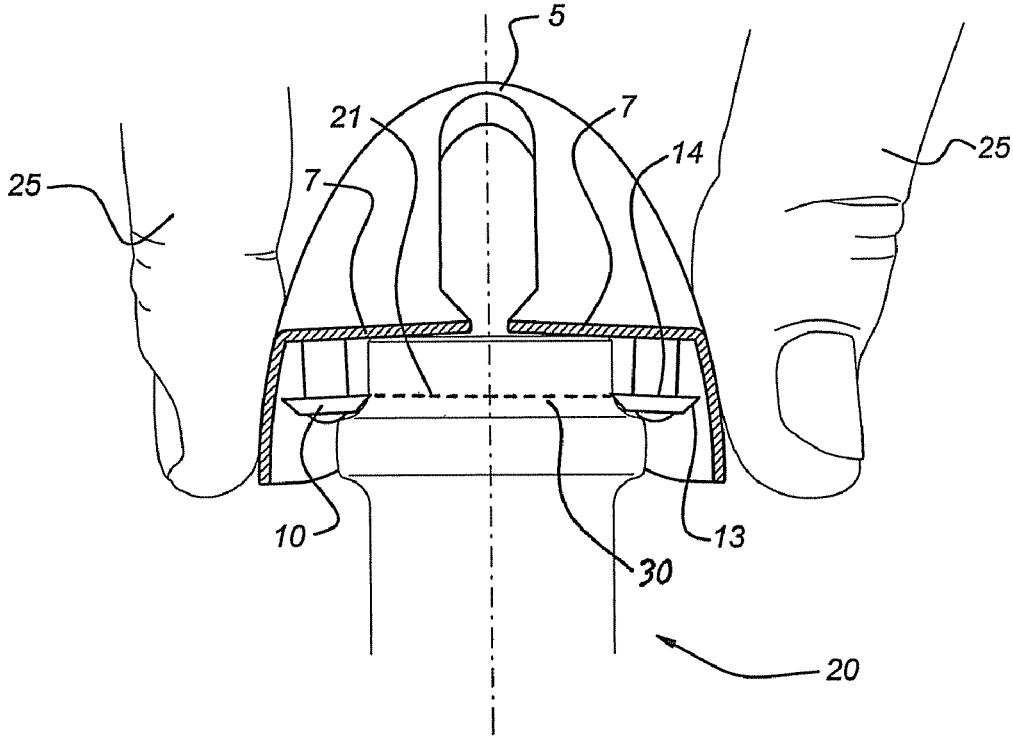
FIG. 6 shows the cross-section according to FIG. 5 during cutting of the foil.

Because of the natural resiliency of the material used for the bridge sections 4 and 5, the cutting device according to the subject application will be in an outwardly moved position at normal engagement, i.e. without pinching. Because of that it is relatively simple to position the cutting edges above the free extremity 22 of a bottle 20 provided with a foil 21 to be removed. This is shown in FIG. 5. In FIG. 6 the position is shown wherein the stop surfaces 9 engage the upper side of the bottle. This determines the position of the cutting line 30 of the cutting knives on the bottle. This distance corresponds to the distance a mentioned above. It has been found that in this position the foil material is not tensioned against the neck of the bottle, because of the bead 24 in the glass material below. Because of the transferal of this bead 24 to the neck proper, the foil material will be spaced from the wall. However, for proper functioning it is not absolutely necessary that the cutting knives are in this position. This position only simplifies cutting.

In FIG. 6 the position is shown wherein the fingers 25 of the user engage the walls 19 and more in particular the cavities 16 for moving the side portions 2 and 3 towards each other and so pressing of the cutting wheels 10 against the foil material. After cutting has been effected, the upper part of the foil material will move back somewhat because of resiliency as has been shown enlarged in FIG. 6. Because of that an outwardly extending portion results which can easily be removed. If the user during removal of the cutting device does not immediately remove full pressure from the cutting wheels, with the flat surface 14 a further running-up effect can be obtained, facilitating removal of the foil material. With the subject invention it is possible to engage a broad range of bottlenecks and to remove the foil being present thereon. As example a range of 24-34 mm is mentioned.

Figure 4:
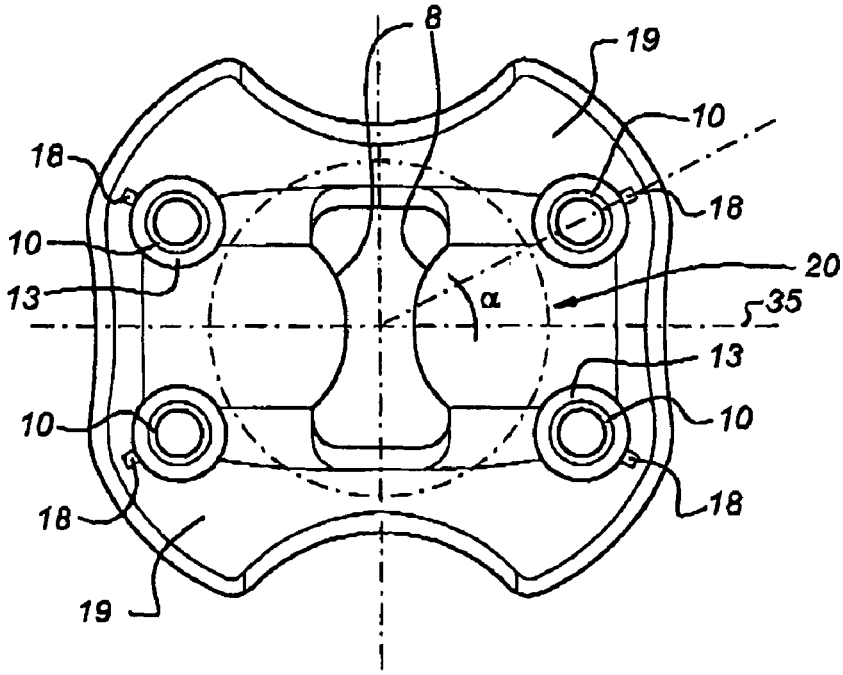
FIG. 4 shows a lower view from the device according to FIG. 1 in the position of positioning the cutting device on a bottle.

In FIG. 4 35 denotes an axis according to which the two side portions 2 and 3 move towards each other. Because the cutting wheels 10 of the cutting portions effect the same movement when moving together the angle $\alpha$ between the cutting wheel and the axis 35 of a side portion will increase during inward movement.

This is embodied in such a way that at cuttingly engaging the user has only to rotate a quarter of a revolution to cut the foil completely. This can be effected if the cutting wheels have an angle $\alpha$ (FIG. 4) of 28-41° relative to the line 35 in the starting position. At downward movement this angle will change to 30-45°.

Because of the presence of the opening 17 the user can see during rotation whether a cutting line 30 has been effected. On the other hand this opening 17 is provided such that the cutting knives themselves cannot be seen. In FIG. 2 the minimum width w of this opening 17 is shown. The minimum width w is obtained if the stops 8 engage each other. This minimum width w is preferably at least 10 mm and more preferably about 15 mm.

Although the invention has been described referred to a preferred embodiment, variance being within the range of the appended claims will immediately be clear for the person skilled in the art. Furthermore it has to be understood that all embodiments mentioned in the subclaims can be used separately, i.e. without combination of the independent claims and rights are claimed therefor.

The invention claimed is:

1. A foil cutting device for cutting of a sealing foil of a bottle comprising two side portions connected by an upper portion to be placed on a free extremity of the bottle, wherein each side portion comprises a support point for engagement on a bottle, wherein each side portion comprises a cutting knife, wherein said side portions and said upper portion are manufactured from a single part of injection-molded material, wherein a pivot line of the two side portions is substantially parallel to a line drawn through a point of engagement of the support points or a line drawn through a point of engagement of the cutting knife of the side portion on said bottle, said upper portion comprising an L-shaped material section, wherein said side portions together with the cutting knife are arranged such that they move towards each other when a pinching force is exerted on said side portions, wherein said side portions comprise interacting stopping means for restricting movement of the side portions towards each other, and wherein the stopping means are provided between the respective support points and cutting knives of each of the side portions.

2. The cutting device according to claim 1, wherein the upper portion comprises two spaced bridges.

3. The cutting device according to claim 2, wherein between said spaced bridges a cavity for a bottle closure is defined.

4. The cutting device according to claim 1, wherein the cutting knives are positioned on the support points.

5. The cutting device according to claim 1, wherein in the position of said side portions being brought together between the side portions externally an opening is delimited.

6. The cutting device according to claim 5, wherein the minimum width of said opening is about 10 mm.

7. The cutting device according to claim 5, wherein in at least one of the side portions adjacent to said opening an accommodation for receiving a finger is provided.

8. The cutting device according to claim 1, wherein said side portions comprise further stopping means for determining the distance between the lower side of said further stopping means and the cutting surface of said cutting knife, and wherein said distance is between 3-8 mm.

9. The cutting device according to claim 8, wherein said stopping means comprises said further stopping means.

10. A foil cutting device for cutting of a sealing foil of a bottle comprising two side portions connected by an upper portion to be placed on a free extremity of the bottle, wherein each side portion comprises a support point for engagement on a bottle, wherein a each of the side portions comprises a cutting knife, wherein said side portions and said upper portion are manufactured from a single part of material, said upper portion comprising an L-shaped material section, wherein said cutting knives each comprise a cutting wheel having an axis of rotation substantially perpendicular to a pivot line of the cutting device defined between said two side portions, wherein said cutting wheel conically flares in the direction of said upper portion up to a flat surface of the cutting wheel.

* * * * *

UNITED STATES PATENT AND TRADEMARK OFFICE

CERTIFICATE OF CORRECTION

PATENT NO. : 7,506,445 B2
APPLICATION NO. : 11/483973
DATED : March 24, 2009
INVENTOR(S) : Buyse et al.

It is certified that error appears in the above-identified patent and that said Letters Patent is hereby corrected as shown below:

Column 6, Line 9, Claim 10, “wherein a each” should read -- wherein each --

Signed and Sealed this

Fourteenth Day of July, 2009

JOHN DOLL
*Acting Director of the United States Patent and Trademark Office*